US007918698B2

(12) United States Patent
Schloegel

(10) Patent No.: US 7,918,698 B2
(45) Date of Patent: Apr. 5, 2011

(54) BOAT WITH A PERIPHERAL FLOAT, PARTICULARLY INFLATABLE LIFE RAFT

(75) Inventor: Christian Schloegel, Avignonet Lauragais (FR)

(73) Assignee: Zodiac International (FR)

( * ) Notice: Subject to any disclaimer, the term of this patent is extended or adjusted under 35 U.S.C. 154(b) by 270 days.

(21) Appl. No.: 12/313,768

(22) Filed: Nov. 24, 2008

(65) Prior Publication Data

US 2009/0133615 A1 May 28, 2009

(30) Foreign Application Priority Data

Nov. 27, 2007 (FR) ..... 07 08286

(51) Int. Cl.
*B63B 9/04* (2006.01)

(52) U.S. Cl. ..... 441/35; 441/38

(58) Field of Classification Search ..... 441/35, 441/38–40; 114/346

See application file for complete search history.

(56) References Cited

U.S. PATENT DOCUMENTS

| | | | | |
|---|---|---|---|---|
| 3,092,854 | A * | 6/1963 | Manhart | 441/38 |
| 6,941,887 | B2 * | 9/2005 | Monlezun | 114/345 |
| 7,357,688 | B2 * | 4/2008 | Ferrara | 441/35 |

FOREIGN PATENT DOCUMENTS

| | | |
|---|---|---|
| GB | 933 477 | 8/1963 |
| GB | 1201915 | 8/1970 |
| GB | 2 171 364 | 8/1986 |
| GB | 2 403 689 | 1/2005 |
| JP | 10297587 | 11/1998 |
| WO | WO-9717251 | 5/1997 |

* cited by examiner

*Primary Examiner* — Stephen Avila

(74) *Attorney, Agent, or Firm* — Dean W. Russell; Kilpatrick Townsend & Stockton LLP

(57) ABSTRACT

The invention relates to a boat (1) with a general contour defined by a periphery of predetermined shape and comprising a float (2) closed on itself along the periphery and formed by at least one floating tube (3); this tube is longer than this periphery and extends locally within the periphery towards the inside (INT) of the boat and has a curved portion (5) with a concavity turned towards the outside (EXT) and defining a re-entrant zone (7); a tent fabric (15) is fixed, along the periphery defining the general contour of the boat, to the tube except for the portion (5) defining the re-entrant zone (7).

20 Claims, 6 Drawing Sheets

BOAT WITH A PERIPHERAL FLOAT, PARTICULARLY INFLATABLE LIFE RAFT

CROSS REFERENCE TO RELATED APPLICATION

This application claims priority to French Patent Application No. FR 07 08286 filed on Nov. 27, 2007, the contents of which are incorporated herein by reference.

FIELD OF THE INVENTION

The present invention relates to improvements to boats having a general contour defined by a periphery of predetermined shape and comprising a float which is closed on itself along said periphery and which comprises at least one floating tube that is longer than said periphery which defines the general contour of the boat, which extends locally within said periphery towards the inside of the boat and which has at least one curved portion with a concavity turned towards the outside defining at least one re-entrant zone into which a person in the water can get and gain purchase with his elbows on said curved portion of the tube in order to haul himself up and more easily climb into the boat.

BACKGROUND OF THE INVENTION

It is difficult for a person in the water to climb into a boat by getting over the edge of the latter: because there is no bearing surface for the feet, the person is in practice obliged to grasp the edge of the boat with two hands and to haul himself over the edge with the strength of the arms alone. This difficulty may occur irrespective of the type of boat, for example for a person who has fallen overboard. It is also the case with life rafts, with the particular difficulty that the person in the water may be in a state of panic and/or exhausted, or even injured, which makes it all the more problematical for him to get on board without outside assistance.

Certainly, various items of accessory equipment are known that are designed to be mounted on a boat, notably an inflatable life raft, in order to help a person in the water climb into the boat. These may notably be side halyards or various protrusions on the side of the boat designed to be grasped by the person in the water, flexible ladders (rope ladders or strap ladders) fixed to one edge and floating in the water, bars for example made of wood coupled by flexible ties to one side of the boat, etc. However, because of the very fact that they lack rigidity, these items of equipment are not easy to use, particularly for people who are not experienced in their use. In addition, it is also necessary for the person in the water to make a physical effort to haul himself up onto these items of equipment, which is difficult when this person is exhausted and/or injured.

Furthermore, it is necessary to ensure that the conformation of the boat is such that, when it is fitted with a tent fabric (or canopy) which covers it for the protection of the people on board, the aeration of the internal volume is appropriately provided, and this is done while as much as possible preventing the entry of water, including on a rough sea.

SUMMARY OF THE INVENTION

The object of the invention is to propose an improved boat that is adapted to, at least partly, solve these problems, in particular in the case of inflatable life rafts.

To this end, the invention proposes a boat as mentioned in the preamble, which boat, being arranged according to the invention, is characterized in that it is provided with a tent fabric fixed, along the periphery defining the general contour of the boat, to the tube except for said portion defining said re-entrant zone.

Thanks to this arrangement, the boat is provided with at least one re-entrant zone that is engaged inside the general contour of the boat, or in other words provided with at least one crank of the tube or tubes turned towards the inside. Therefore, a person in the water can get into this re-entrant zone and is therefore already positioned at least partly in the boat. In addition, this person may place his elbows on the said curved portion of the tube which thus forms an arm rest and can gain a better assured purchase in order to haul himself up and more easily climb on board. Also, if it involves hauling an inanimate person into the boat from the water, one or preferably two able-bodied people in the boat alongside this re-entrant zone are much more able to grasp him and haul him aboard.

The proposed arrangement may be assimilated to an entrance chamber incorporated into the boat suitable for facilitating access on board for a person in the water who is either seeking to climb into it by his own means, or who must be hauled into it by third parties who are already on board.

Also it should be underlined that not only does this arrangement make it easier to get on board as explained above, but additionally it provides the boat with greater stability when getting on board because the weight of the person is inside the periphery defining the general contour of the boat. Such an advantage is of particular value in an inflatable life raft that is relatively unstable because of its relatively low weight. This stability improvement may further be increased in this type of boat by placing the bottle containing the inflation gas on the opposite side of said re-entrant zone, in order to form a counterweight. The rigidity of the general structure of the inflatable raft contributes to the function. The raft sinks less into the water and the person who is hauling himself has less of an impression of a structure which is collapsing than with a conventional external ladder or ramp. The system is therefore more user-friendly.

In parallel, thanks to the arrangement proposed according to the invention, the re-entrant zone forms a zone or passageway for the aeration of the inside of the boat closed by the tent fabric.

The arrangements specified above may give rise to various practical embodiments.

In a first embodiment, which is currently preferred, it is provided that:

- said float comprises at least two floating tubes, namely a lower floating tube and an upper floating tube, superposed over the whole of their length,
- said two tubes, the lower tube and upper tube, are both longer than the said periphery defining the general contour of the boat,
- said two tubes, the lower tube and upper tube, extend locally within said periphery towards the inside of the boat and have at least one curved portion with a concavity turned towards the outside, and
- the tent fabric is fixed to the upper tube except for said portion defining said re-entrant zone.

Therefore, the boat is provided with at least one re-entrant zone into which a person in the water can easily get and gain purchase with his elbows on said curved portion of the upper tube in order to haul himself up and more easily climb into the boat. In addition, the structure thus formed is relatively simple to manufacture since the two tubes are arranged in the same manner.

Advantageously, provision can be made for a wall, notably preferably made of a substantially flexible material, to be stretched across said re-entrant zone, said wall being secured to the lower tube beneath the latter along said curved portion. This produces a bearing surface on which the person in the water can place at least one leg, and may even kneel at the same time as he gains purchase with his elbows on the upper tube.

In a second possible embodiment, it is provided that:

said float comprises at least two floating tubes, namely a lower floating tube and an upper floating tube, superposed over a major portion of their length, said lower floating tube extends along said periphery delimiting the general contour of the boat, said upper floating tube is longer than said periphery defining the general contour of the boat and extends locally within said periphery towards the inside of the boat having at least one curved portion with a concavity turned towards the outside, at least one cover, notably preferably made of a substantially flexible material, is fixed beneath said at least one curved portion of the upper tube and on the portion of the lower tube bordering said at least one curved portion, and the tent fabric is fixed to the upper tube except for said portion defining said re-entrant zone.

Therefore, the boat is provided with at least one shelf flush with the water in said at least one re-entrant zone onto which a person in the water can get and gain purchase with his elbows on said curved portion of the upper tube in order to haul himself up and more easily climb into the boat. The presence of this shelf level with the water can significantly help the person to haul himself into the boat and to require thereof less effort than in the first aforementioned embodiment in which the person must get on board directly from the water without intermediate purchase; the presence of this shelf level with the water may therefore be of great help particularly if the person is exhausted or injured.

The features according to the invention have the value of being able to be applied easily in all types of boat. Therefore, if the boat has a substantially round general shape with a substantially circular periphery as is frequently encountered for life rafts, said at least one re-entrant zone may be situated in at least any one location of said periphery; similarly, if the boat has a substantially polygonal general shape with the float formed by a plurality of substantially rectilinear successive sections, said at least one re-entrant zone may advantageously be situated substantially in the middle of at least one of said sections; in particular, if the boat has a substantially quadrangular general shape, notably substantially rectangular or square, with the float formed by four substantially rectilinear successive sections as is frequently encountered in life rafts, said at least one re-entrant zone is situated substantially in the middle of at least one of said sections.

In a worthwhile embodiment that is simple to manufacture, provision is made for said at least one re-entrant zone to be generally V-shaped, notably preferably with a flattened point conferring a general U-shape with splayed branches which makes it easier for a person to get on board.

The implementation of the features according to the invention seems certain to find a particularly worthwhile application if each tube is pneumatically inflatable, as is frequently the case for life rafts, notably for life rafts designed for leisure boating.

It is possible for said wall and/or said cover to be made of a substantially flexible and solid material. But preferably said wall and/or said cover is made of a flexible open work material, notably mesh. Thanks to this arrangement, the presence of the wall and/or of the cover made of substantially flexible open work material in no way prevents the outside air from entering, via said re-entrant zone, the inside of the boat closed by the tent fabric.

As emerges from the foregoing explanations, the features according to the invention seem certain to find an application that is most particularly preferred in life rafts, notably of the pneumatic type with inflatable tube(s), in particular designed for leisure boating; in the latter case, the life raft, designed for a small number of persons, has relatively small dimensions and it is sufficient for it to be provided with a single re-entrant zone; then advantageously, if the raft is provided with a weighty item of equipment, notably a bottle of inflation gas, this weighty item of equipment is placed substantially on the opposite side to said re-entrant zone.

BRIEF DESCRIPTION OF THE DRAWINGS

The invention will be better understood on reading the following detailed description of certain exemplary embodiments given only for purely illustrative purposes. In this description, reference is made to the appended drawings in which.

DETAILED OF THE INVENTION

The invention aims to improve boats having a general contour defined by a periphery of predetermined shape and comprising a float which is closed on itself along said periphery and which comprises at least one floating tube.

The invention aims preferably, but not exclusively, at inflatable boats in which the floating tube is pneumatically inflatable, and it may notably apply, still preferably, to life rafts that are frequently provided with at least two superposed pneumatic tubes. It is therefore more particularly in the context of the latter conformation that the following detailed description will be set out with reference to the appended drawings, it being understood that this description does not limit the fields of application of the arrangements of the invention.

Figure 1A:
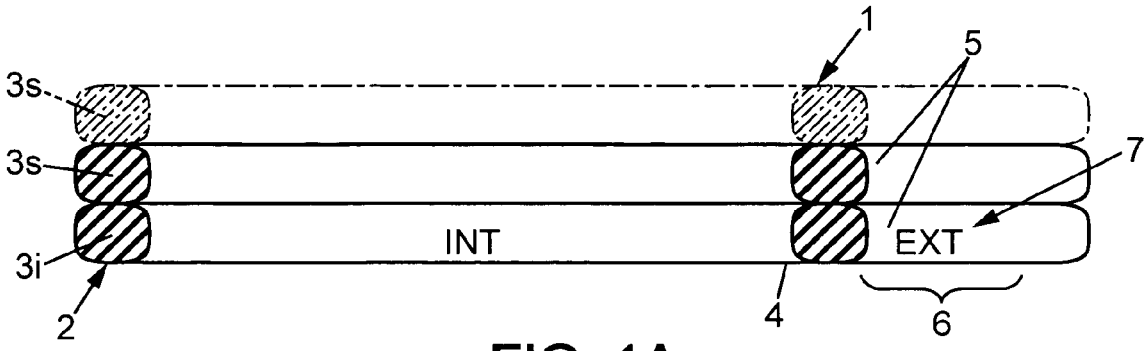
FIG. 1A is a very schematic view in cross section of a boat related to by the invention and arranged according to a first embodiment.
Figure 1B:
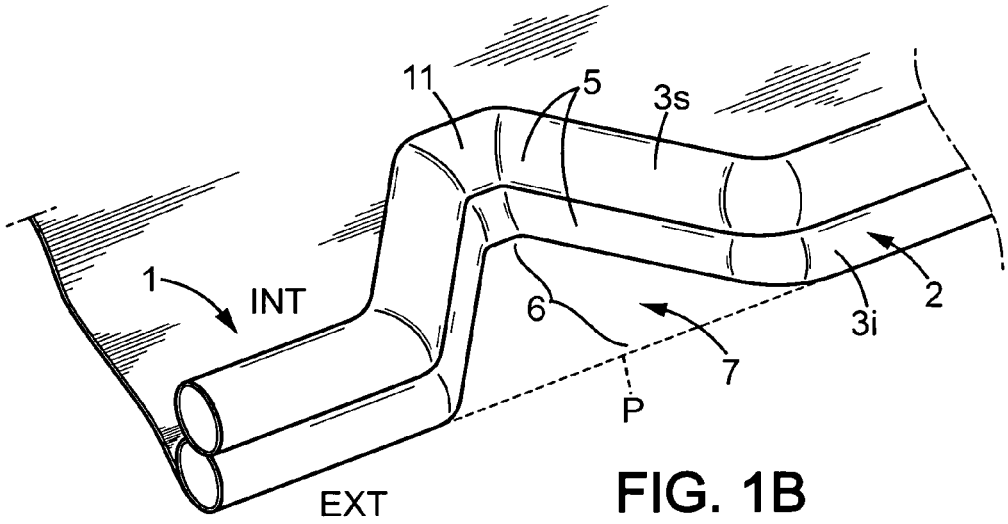
FIG. 1B is a simplified view in perspective of a portion of the boat of FIG. 1A.

FIGS. 1A and 1B illustrate a first embodiment which is currently preferred, of the arrangements relating to a boat to which the invention is directed.

First of all with reference to FIG. 1A, a boat 1 (for example a life raft) has any general contour that is defined by a predetermined periphery P materialized by a float 2 which is closed on itself along said periphery and which comprises at least one floating tube 3. The or each tube 3 may be constituted in any appropriate manner in relation to its longitudinal shape (shape of the contour of the boat), the shape of its cross section and its design (inflatable tube, or solid tube made of appropriate material(s)). A bottom 4 of any structure, rigid (notably when the tube 3 is solid) or flexible (notably when the tube 3 is inflatable) is secured to the underneath of the tube 3.

Said at least one tube 3 is longer than said periphery P defining the general contour of the boat 1. In addition, said at least one tube 3 extends locally within said periphery towards the inside (marked INT) of the boat 1 as schematized by the reference number 6 and has at least one curved portion 5 with a concavity turned towards the outside (marked EXT) of the boat 1.

In FIG. 1A, as an example at least two tubes superposed over the whole of their length are provided, namely a lower tube 3*i* and an upper tube 3*s* (a third upper tube, which is still possible, is drawn in dot-and-dash lines) and each of the two tubes 3*i*, 3*s* is illustrated in solid form with a substantially quadrangular (approximately square) cross section. The two tubes, the lower tube 3*i* and upper tube 3*s*, are both longer than the said periphery defining the general contour of the boat; as is clearer in FIG. 1B, the two tubes, the lower tube 3*i* and upper tube 3*s*, extend locally within the said periphery P towards the inside (INT) of the boat 1 (reference number 6) and each have at least one curved portion 5 with a concavity turned towards the outside (EXT).

The arrangement that has just been described with reference to FIGS. 1A and 1B is of value because the two portions 5 curved towards the inside of the boat define a re-entrant zone 7 with a concavity turned towards the outside (EXT), which forms a sort of shelter into which the person in the water gets by thus entering the inside of the general contour of the boat. This position allows him to easily place his elbows on the top of the upper tube 3*s* and thereby to obtain a sure and stable purchase. The person may therefore haul himself up more easily to tip over the upper tube 3*s* and get on board.

It is possible to make the work of getting on board easier by providing the person in the water with a purchase for the feet and/or the legs.

Figure 2A:
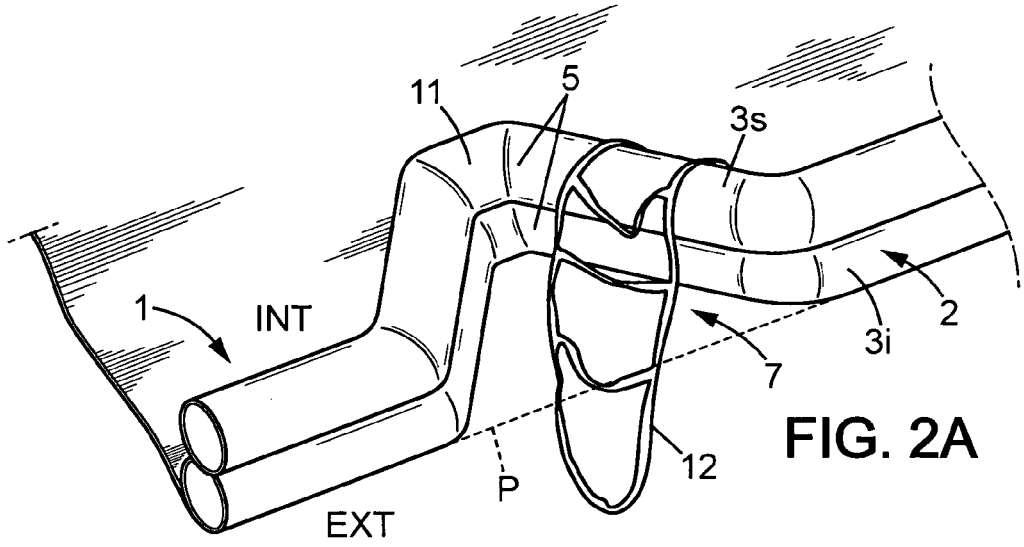
FIGS. 2A to 2C are views in perspective of a portion of the raft of FIG. 1B showing respectively three possibilities of arrangement.

Accordingly, as illustrated in FIG. 2A, it is possible to provide a flexible ladder 12, notably of the type frequently present on life rafts, in said re-entrant zone 7; this ladder is preferably placed as deeply as possible in this re-entrant zone 7 so that the person retains the ability simultaneously to easily gain a purchase with his elbows on the upper tube 3*s*.

Figure 2B:
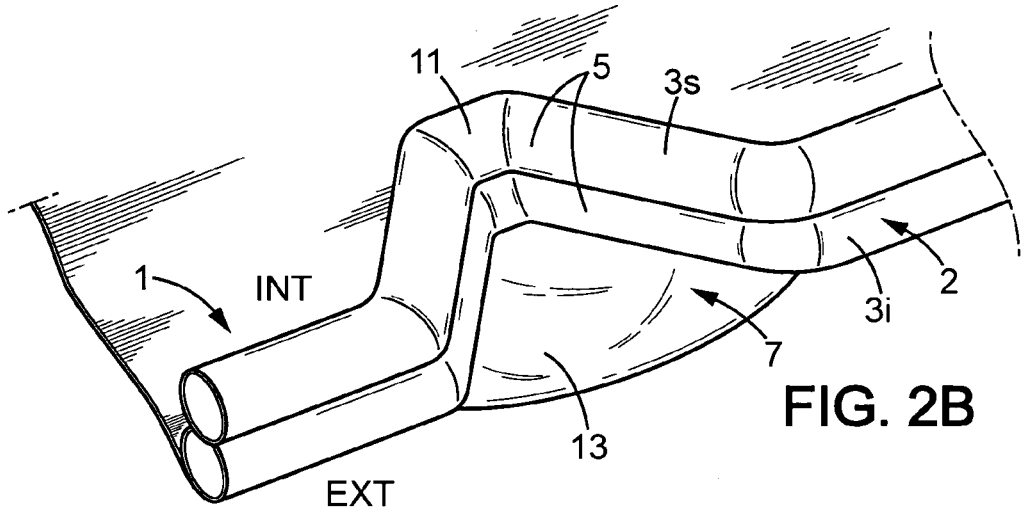
Figure 2C:
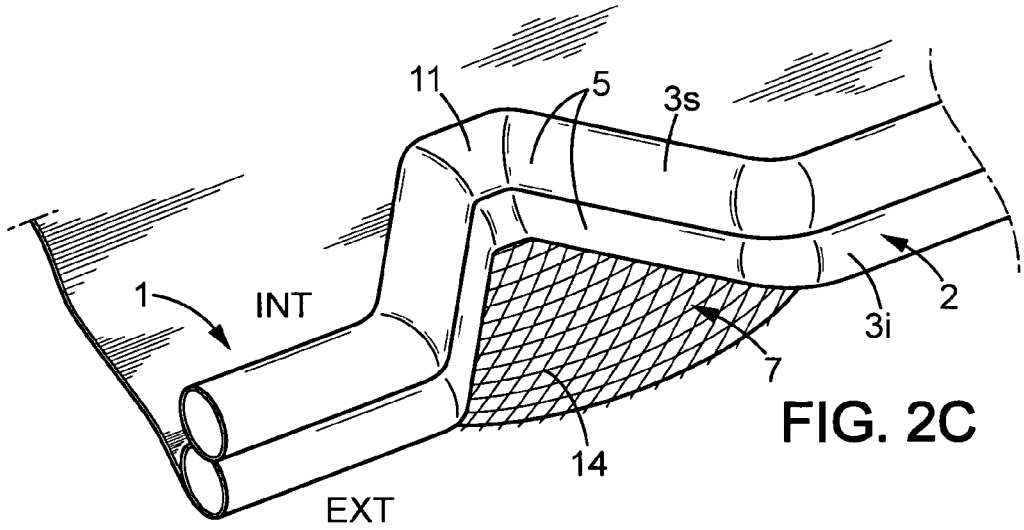

However, a preferred solution consists in providing a wall, preferably made of a substantially flexible material, which is secured to the lower tube 3*i* beneath the latter, along the curved portion 5, so that it extends across the re-entrant zone 7. This wall may be either solid (for example in the form of a woven plate 13 as illustrated in FIG. 2B), or be open work (for example in the form of a mesh 14 as illustrated in FIG. 2C). The person in the water may therefore manage to gain purchase with a leg, or even kneel, on this flexible wall 13, 14 at the same time as he gains purchase with his elbows on the upper tube 3*s*.

Figure 3A:
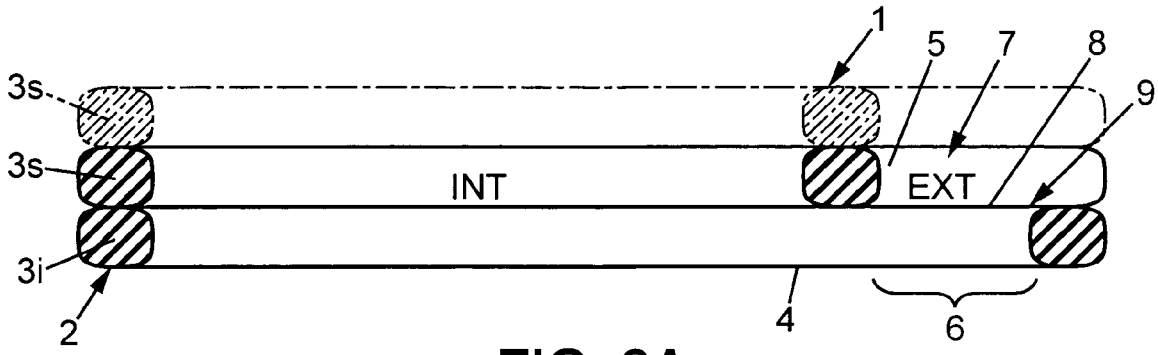
FIG. 3A is a very schematic view in cross section of a boat related to by the invention and arranged according to a second embodiment.
Figure 3B:
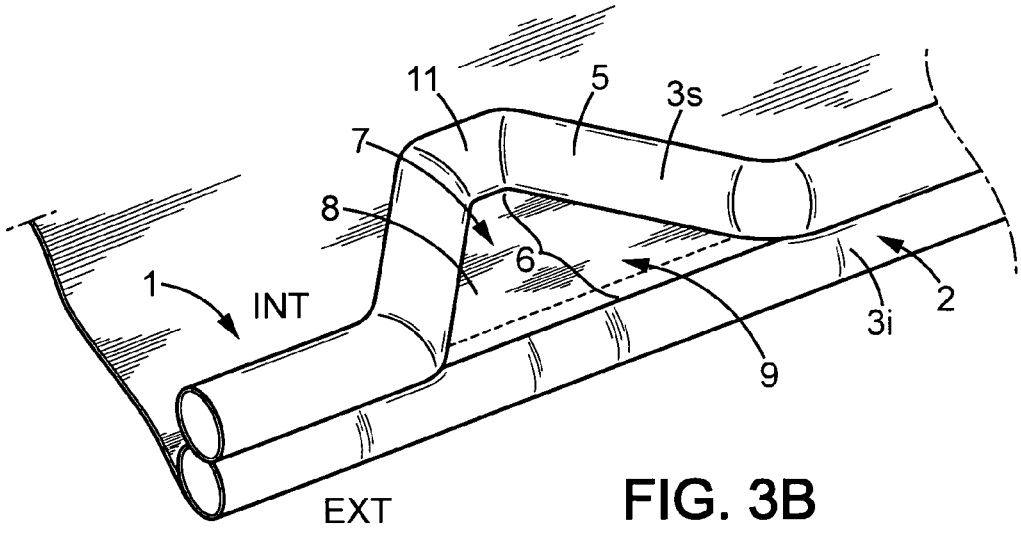
FIG. 3B is a simplified view in perspective of a portion of the boat of FIG. 3A.

Illustrated in FIGS. 3A and 3B is a second embodiment of the arrangements relating to a boat to which the invention is directed still making use of a float 2 formed by at least two floating tubes, a lower tube 3*i* and an upper tube 3*s*, but which, in this instance, are superposed over a major portion of their length and no longer over the totality of their length.

In this arrangement, the lower floating tube 3*i* extends along the periphery delimiting the general contour of the boat 1. The upper floating tube 3*s* is longer than said periphery defining the general contour of the boat 1 and extends locally within said periphery towards the inside (INT) of the boat as suggested by reference number 6 while having at least one curved portion 5 with a concavity turned towards the outside (EXT). Finally, at least one cover 8, notably made of a substantially flexible material in particular when the floating tubes are of the inflatable pneumatic type, is fixed under said at least one curved portion 5 of the upper tube 3*s* and over the portion of the lower tube 3*i* bordering said at least one curved portion. The material forming the cover 8 may be solid, such as a woven material, as shown in FIG. 3B, or else open work, for example of the mesh type (not shown).

The arrangement that has just been described with reference to FIGS. 3A and 3B is of value because said re-entrant zone 7 is limited to the upper tube 3*s*, while the lower tube 3*i* and the cover 8 form a sort of shelf or deck 9 level or virtually level with the water which may provide a further aid to an exhausted or injured person gaining purchase with his elbows on the top of the upper tube as indicated above. Naturally, here again, a flexible ladder could with advantage be provided, hanging from said shelf 9, in order to help the person gain purchase on the shelf 9.

Another value of said arrangements lies in the fact that they may be easily applied in boats of various shapes.

Figure 4A:
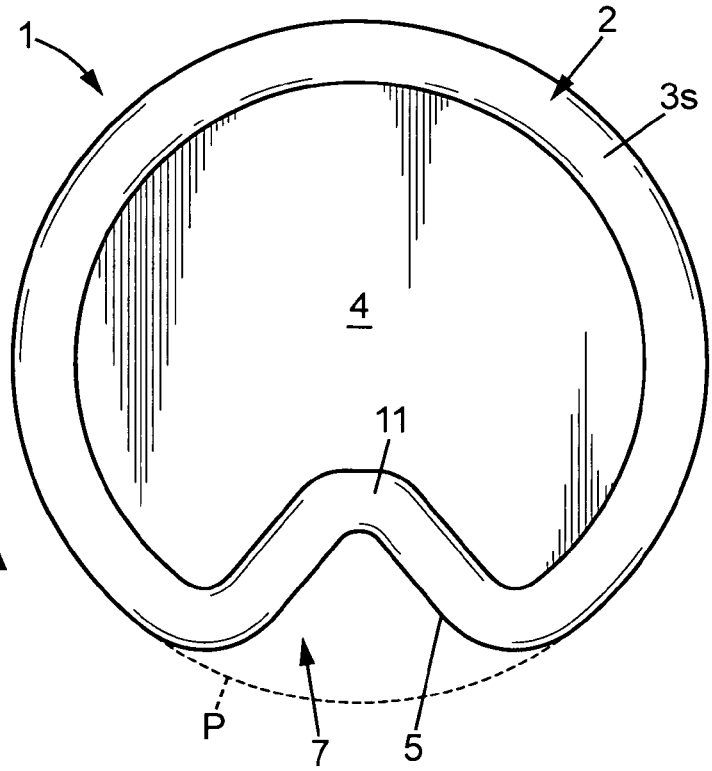
FIGS. 4A and 4B are simplified top views of a first example of a boat fitted according to the arrangement of FIGS. 1A, 1B and FIGS. 3A, 3B respectively.
Figure 4B:
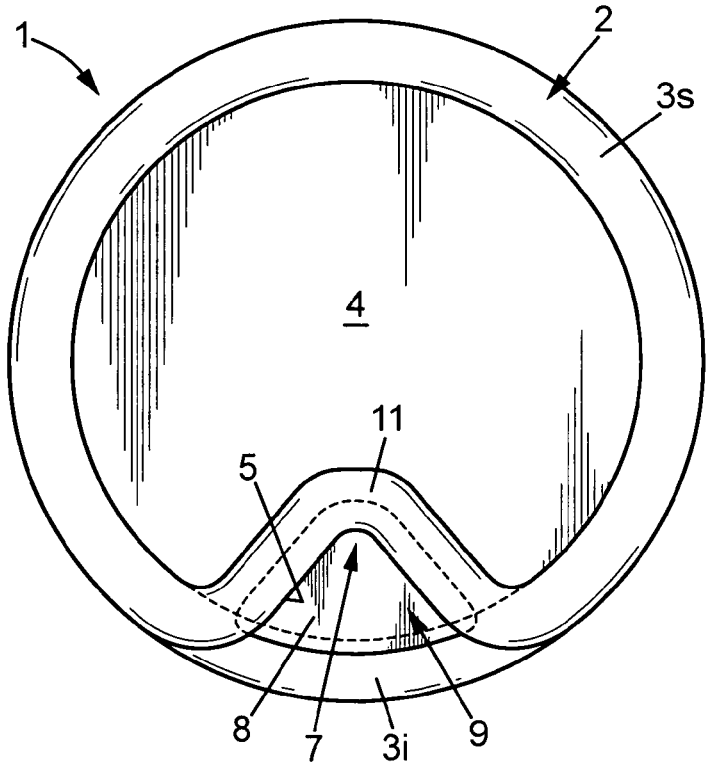

Therefore, as an example, FIGS. 4A and 4B show, in a top view, simplified representations of boats with a substantially round general shape with a substantially circular periphery and in which the or at least one re-entrant zone 7 may be installed in at least any one location of said periphery. In FIG. 4A, the boat 1 is fitted according to the first embodiment explained above with respect to FIGS. 1A and 1B. In FIG. 4B, the boat 1 is fitted according to the second embodiment explained above with respect to FIGS. 3A and 3B.

Figure 5A:
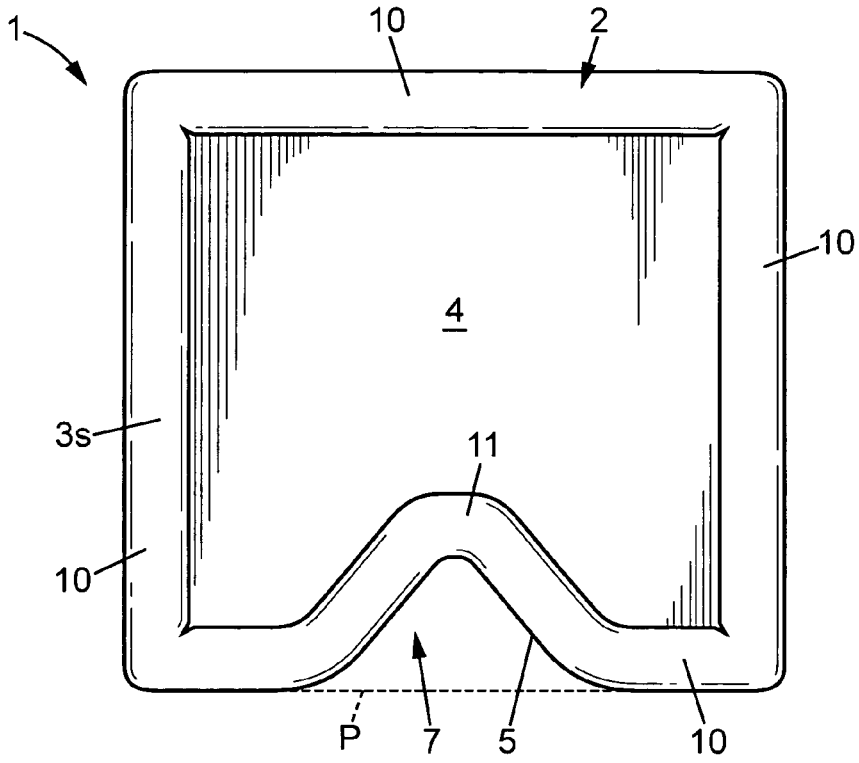
FIGS. 5A and 5B are simplified top views of a second example of a boat fitted according to the arrangements of FIGS. 1A, 1B and FIGS. 3A, 3B respectively.
Figure 5B:
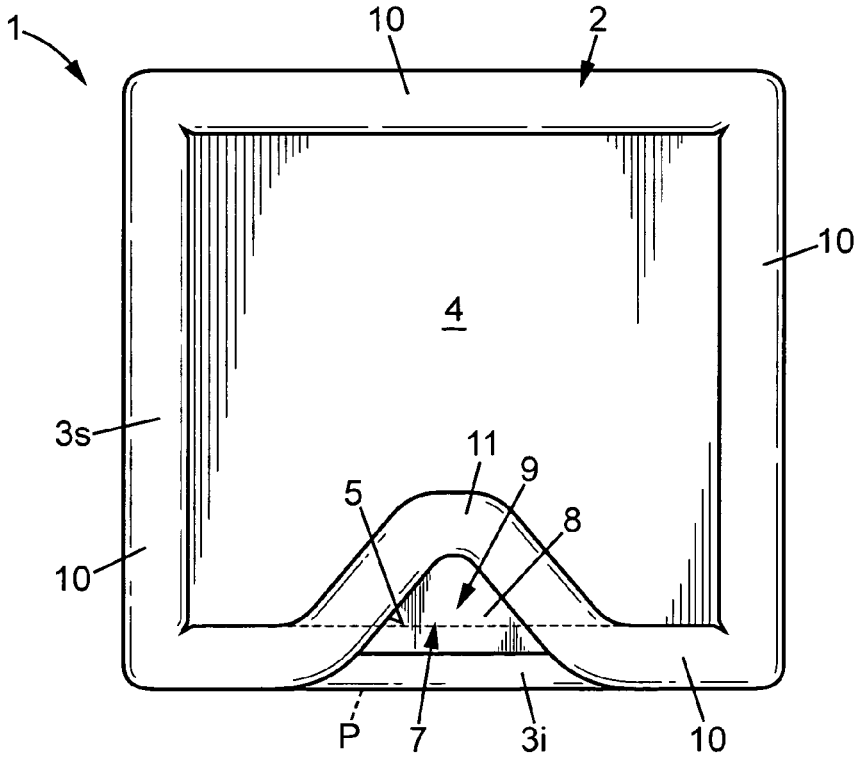

The arrangements explained above may also be applied in boats with a polygonal contour with the float formed by a plurality of substantially rectilinear successive sections and, in this case, the at least one re-entrant zone 7 is situated substantially in the middle of at least one of said sections. This may therefore involve in particular a boat with a substantially quadrangular general shape, notably substantially rectangular or else square as illustrated as an example in FIGS. 5A and 5B, with the float formed by four substantially rectilinear successive sections 10. In this case, said at least one re-entrant zone 7 is situated substantially in the middle of at least one of said sections 10 so as to ensure in the best way possible the stability of the boat during an attempt by a person in the water to get on board.

Although the result that is sought can be obtained with one or more curved portions 5 of any shape, it nevertheless seems of greater value that said at least one re-entrant zone 7 is generally V-shaped, notably with a flattened point (in other words in the general shape of a U with splayed branches), as illustrated at 11 in all the appended figures. Specifically it is this shape which seems the most appropriate for a person in the water to quickly and easily find a stable purchase with the aid of his elbows on the top of the upper tube 3*s*. In addition, if two people situated in the boat wish to pull a third person out of the water, these two people situated on board position themselves on either side of the re-entrant zone 7 and will be best placed, on either side of the person to be pulled, if said re-entrant zone is generally V-shaped.

As clearly emerges from the preceding explanations, the arrangements mentioned seem certain to find a particularly valuable application in inflatable boats in which the or each floating tube 3 is pneumatically inflatable.

More specifically, said arrangements seem certain to find an application that is even more particularly of value in life rafts, notably inflatable life rafts.

The above arrangements may be implemented so that a boat is fitted with any number, appropriate to the envisaged use, of re-entrant zones 7. Since this involves more particularly life rafts designed for leisure boating and therefore of small or relatively small capacity (for example for a small number of people up to approximately 10 or 12 people), it will be sufficient to provide a single re-entrant zone 7.

With respect to maintaining the stability of the boat in particular when it is of the inflatable type, and typically when it is an inflatable life raft which is relatively light, when a person in the water is being brought on board, it is desirable to ensure that the weighty equipment of the boat is placed on the opposite side to the re-entrant zone; this could therefore notably apply to the bottle of inflation gas (relatively heavy metal bottle) for inflatable life rafts.

The boat 1 may be totally or partly covered by a tent fabric (canopy) for the protection of the people on board, such a tent fabric being imposed by regulations for officially approved life rafts.

According to the invention, this tent fabric is fixed, along the periphery defining the general contour of the boat, to said tube 3 except for said portion 5 defining the re-entrant zone 7. The re-entrant zone 7 therefore forms an aeration zone through which the outside air may enter the inside of the boat covered by the tent fabric.

Figure 6A:
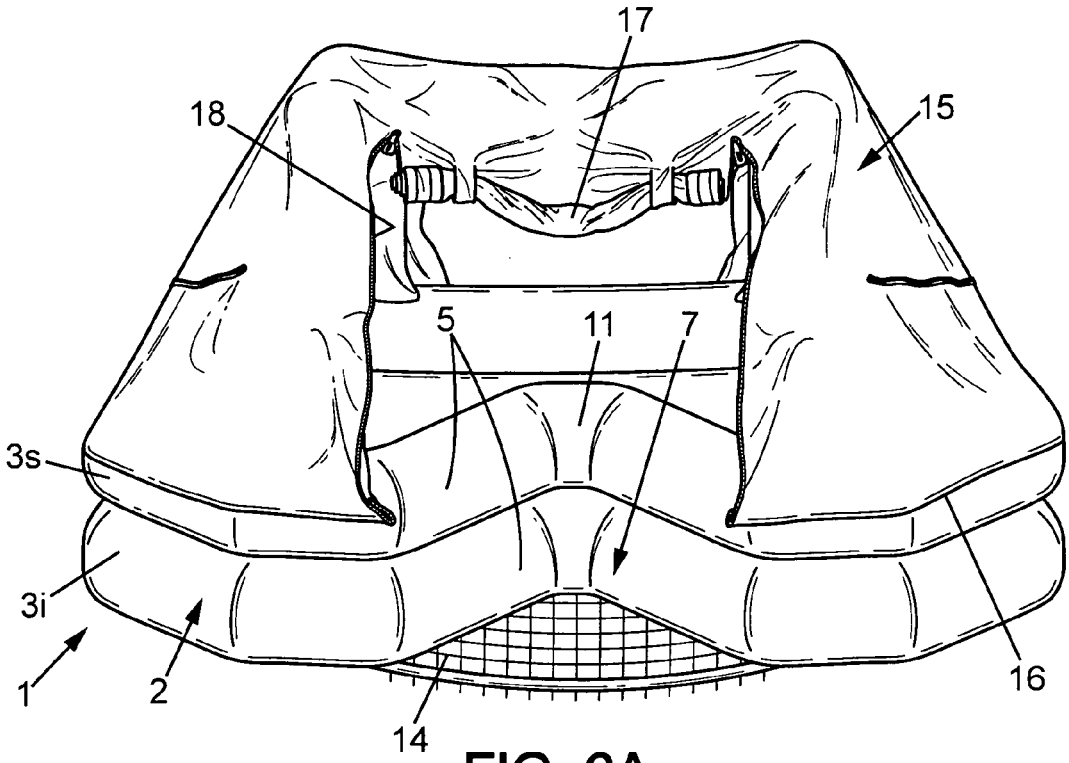
FIGS. 6A and 6B represent, in a front view, an inflatable life raft fitted in accordance with the invention according to the arrangements of FIGS. 1A and 1B, and shown respectively in two different operational situations.

FIG. 6A illustrates, in a front view, an inflatable life raft with two superposed tubes fitted with a tent fabric 15 which is held in position by any known means (for example by one or more support frames that may if necessary be inflatable). According to the invention, the lower edge 16 of this tent fabric is secured to the upper tube 3*s* over the whole periphery of the latter except for said portion 5 delimiting the re-entrant zone 7. The tent fabric 15 is therefore fixed to the upper tube along the periphery P defining the general contour of the boat. The tent fabric 15 is furnished with at least one fabric panel 17 that can be lifted which, in the raised position as shown in FIG. 6A, forms an access door 18. This fabric panel 17 is situated in line with the re-entrant zone 7, so that a person in the water can enter or be hauled into the raft from said re-entrant zone 7.

Figure 6B:
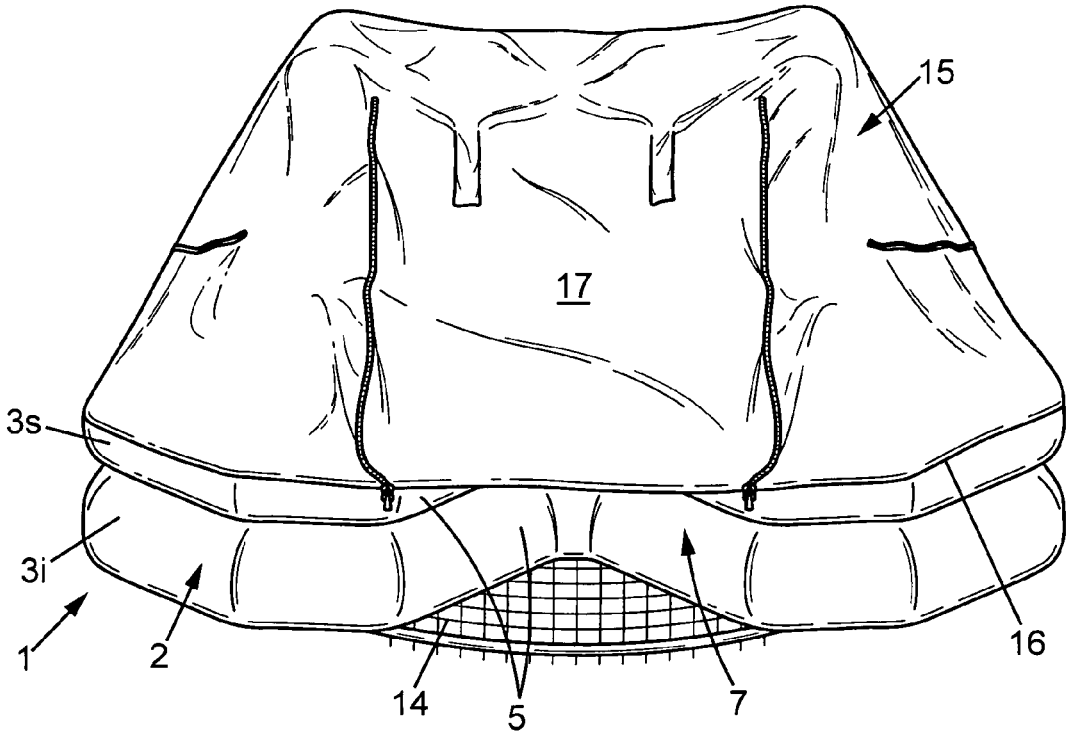

Such an arrangement is worthwhile to be applied, in a preferred manner, in the context of the first embodiment of FIGS. 1A, 1B, or else in the context of this first embodiment of FIGS. 1A, 1B in conjunction with a wall 14 made of substantially flexible open work material, such as a mesh, specified above with reference to the representation of FIG. 2C, or if necessary also in the context of the second embodiment of FIGS. 3A, 3C in conjunction with a cover 8 made of substantially flexible open work material, such as a mesh (not illustrated). In these conditions, when the fabric panel 17 is folded in the closed position as shown in FIG. 6B, the re-entrant zone 7 may continue to play its role as an aeration zone (vent) allowing the outside air to enter, if necessary through the wall 14 and/or the cover 8 made of substantially flexible open work material, inside the boat closed by the tent fabric 15. This gives a natural ventilation of the inside of the raft which is particularly effective if the surface of the water does not remain flat.

It will also be noted that straps (not shown) installed on the portion 5 of the upper tube 3*s* delimiting the re-entrant zone 7 may be used as handles which the person can grasp in order to haul himself up more easily.

What is claimed is:

1. A boat having a general contour defined by a periphery of predetermined shape and comprising a float which is closed on itself along said periphery and which comprises at least one floating tube that is longer than said periphery defining the general contour of the boat, which extends locally within said periphery towards the inside of the boat and which has at least one curved portion with a concavity turned towards the outside defining at least one re-entrant zone into which a person in the water can get and gain purchase with his elbows on the said curved portion of the tube in order to haul himself up and more easily climb into the boat, said boat being fitted with a tent fabric fixed, along the periphery defining the general contour of the boat, to the tube except for said portion defining said re-entrant zone, whereby said re-entrant zone forms a zone for the aeration of the inside of the boat closed by the tent fabric; and wherein:

said float comprises at least two floating tubes, namely a lower floating tube and an upper floating tube, superposed over the whole of their lengths, said two tubes, the lower tube and upper tube, are both longer than said periphery defining the general contour of the boat, said two tubes, the lower tube and upper tube, extend locally within said periphery towards the inside of the boat and have at least one curved portion with a concavity toward towards the outside, said tent fabric is fixed to the upper tube except for said portion defining said re-entrant zone, and a wall is stretched across said re-entrant zone, said wall being secured to the lower tube beneath the latter along said curved portion.

2. A boat having a general contour defined by a periphery of predetermined shape and comprising a float which is closed on itself along said periphery and which comprises at least one floating tube that is longer than said periphery defining the general contour of the boat, which extends locally within said periphery towards the inside of the boat and which has at least one curved portion with a concavity turned towards the outside defining at least one re-entrant zone, said boat being fitted with a tent fabric fixed, along the periphery defining the general contour of the boat to the tube except for said portion defining said re-entrant zone, whereby said re-entrant zone forms a zone for the aeration of the inside of the boat closed by the tent fabric; and wherein:

said float comprises at least two floating tubes, namely a lower floating tube and an upper floating tube, superposed over a major portion of their length, said lower floating tube extends along said periphery delimiting the general contour of the boat, said upper floating tube is longer than said periphery defining the general contour of the boat and extends locally within said periphery towards the inside of the boat having at least one curved portion with a concavity turned towards the outside, at least one cover is fixed beneath said at least one curved portion of the upper tube and on the portion of the lower tube bordering said at least one curved portion, and said tent fabric is fixed to the upper tube except for the said portion defining said re-entrant zone, whereby the boat is provided with at least one shelf approximately flush with the water in said at least one re-entrant zone onto which a person in the water can get and gain purchase with his elbows on said curved portion of the upper tube in order to haul himself up and more easily climb into the boat.

3. The boat according to claim 1, wherein said boat has a substantially round general shape with a substantially circular periphery, and wherein said at least one re-entrant zone is situated in at least any one location of said periphery.

4. The boat according to claim 1, wherein said boat has a substantially polygonal general shape with the float formed by a plurality of substantially rectilinear successive sections, and wherein said at least one re-entrant zone is situated substantially in the middle of at least one of said sections.

5. The boat according to claim 4, wherein said boat has a substantially quadrangular general shape, notably substantially rectangular or square, with the float formed by four substantially rectilinear successive sections, and wherein said at least one re-entrant zone is situated substantially in the middle of at least one of said sections.

6. The boat according to claim 1, wherein said at least one re-entrant zone is generally V-shaped, notably with a flattened point.

7. The boat according to claim 1, wherein each tube is pneumatically inflatable.

8. The boat according to claim 1, wherein said wall is made of substantially flexible and solid material.

9. The boat according to claim 1, wherein said wall is made of a substantially flexible open work material, notably mesh, whereby said re-entrant zone forms a zone of aeration, through the wall cover made of substantially flexible open work material, of the inside of the boat closed by the tent fabric.

10. An inflatable life raft, being constructed according to claim 1.

11. The inflatable life raft according to claim 10, designed for leisure boating, comprising a single re-entrant zone.

12. The inflatable life raft according to claim 10, comprising a single re-entrant zone, and wherein a weighty item of equipment of said raft, notably a bottle of inflation gas, is placed substantially on the opposite side to said re-entrant zone.

13. The boat according to claim 2, wherein said boat has a substantially round general shape with a substantially circular periphery, and wherein said at least one re-entrant zone is situated in at least any one location of said periphery.

14. The boat according to claim 2, wherein said boat has a substantially polygonal general shape with the float formed by a plurality of substantially rectilinear successive sections, and wherein said at least one re-entrant zone is situated substantially in the middle of at least one of said sections.

15. The boat according to claim 14, wherein said boat has a substantially quadrangular general shape, notably substantially rectangular or square, with the float formed by four substantially rectilinear successive sections, and wherein said at least one re-entrant zone is situated substantially in the middle of at least one of said sections.

16. The boat according to claim 2, wherein said at least one re-entrant zone is generally V-shaped, notably with a flattened point.

17. The boat according to claim 2, wherein each tube is pneumatically inflatable.

18. An inflatable life raft, being constructed according to claim 2.

19. The inflatable life raft according to claim 18, designed for leisure boating, comprising a single re-entrant zone.

20. The inflatable life raft according to claim 18, comprising a single re-entrant zone, and wherein a weighty item of equipment of said raft, notably a bottle of inflation gas, is placed substantially on the opposite side to said re-entrant zone.

* * * * *